United States Patent [19]

Bonalumi

[11] 4,300,464

[45] Nov. 17, 1981

[54] THREAD TENSION CONTROL FOR SEWING MACHINES

[75] Inventor: Pietro Bonalumi, Cernusco Sul Naviglio, Italy

[73] Assignee: Rockwell-Rimoldi, S.p.A., Milan, Italy

[21] Appl. No.: 91,686

[22] Filed: Nov. 5, 1979

[30] Foreign Application Priority Data

Dec. 13, 1978 [IT] Italy ..... 30771 A/78

[51] Int. Cl.[3] ..... D05B 27/10; D05B 47/04; D05B 63/00

[52] U.S. Cl. ..... 112/254; 112/166

[58] Field of Search ..... 112/254, 255, 305, 318, 112/315, 312, 314, 313, 16, 18, 121.26, 166, 165, 322, 47, 304, 14, 83, 267.1; 242/150 M

[56] References Cited

U.S. PATENT DOCUMENTS

| | | | |
|---|---|---|---|
| 1,197,055 | 9/1916 | Onderdonk | 112/16 |
| 2,540,983 | 2/1951 | Hacklander | 112/322 X |
| 2,725,840 | 12/1955 | Zeier | 112/254 |
| 2,938,479 | 5/1960 | Armstead, Jr. | 112/254 |
| 3,960,097 | 6/1976 | Block | 112/322 |
| 4,166,423 | 9/1979 | Brienza et al. | 112/254 |
| 4,182,248 | 1/1980 | Klages | 112/121.26 |

*Primary Examiner*—Werner H. Schroeder
*Assistant Examiner*—Andrew M. Falik

[57] ABSTRACT

A separate pair of tensioning elements for the needle thread and for the looper thread in sewing machines adapted to form seams of stitches on a succession of workpieces which are advanced in the direction of sewing by a main transport device and an auxiliary transport device disposed in spaced relation to the latter. A sensing device and control device is operatively associated with the tensioning elements and tension is caused to be applied by each pair of elements on their respective thread when a workpiece is present in the main transport device. Upon advance of the workpiece to a point where its advance is effected solely by the auxiliary transport device, the tension imposed by one of each pair of elements is automatically released.

2 Claims, 3 Drawing Figures

THREAD TENSION CONTROL FOR SEWING MACHINES

BACKGROUND OF THE INVENTION

The present invention pertains to a thread tension control for sewing machines which in addition to their main transport device for advancing a workpiece that is operatively associated with the stitching instrumentalities, they are also provided with an auxiliary transport device which is disposed in alignment with and downstream of said stitching instrumentalities.

These auxiliary transport devices serve to assist in the advance of a workpiece and at the same time maintain it in a stretched state so as to oppose the tension to which the threads are subjected by the stitching instrumentalities during stitch formation thereby preventing such tension from causing a puckering of the fabric defining the workpiece during the formation of each stitch.

When forming a seam with stitches of the double chain type and the stitches extend parallel with and adjacent the edge of a workpiece, the tension to which the threads are subjected while being manipulated to form a stitch create a condition which causes bunching, puckering or in other words a reduction in the intended length of said workpiece and is responsible in forming stitches therein of a length less than that desired. In practice such bunching or puckering is more prevalent and pronounced in a workpiece when there is a decrease in the consistency thereof and when the spacing between the successive penetrations of the needle into the workpiece is caused to be increased.

This undesirable condition of puckering of a workpiece during the stitching cycle is overcome by the auxiliary transport device which serves to draw said workpiece toward it by an amount that is equal to or slightly greater than the amount being advanced by the main transport device of the sewing machine.

Control of the workpiece in this manner provides a means of eliminating the condition of puckering by opposing the tension of the thread so that said tension is effective in completing each stitch that is formed with the desired degree of tightness.

The auxiliary transport device performs its intended function satisfactorily during the seaming cycle; however, after the last stitch is formed in the workpiece and it is advanced beyond the main transport device and the stitching instrumentalities, the chain of stitches which continues to be formed prior to the start of seaming on the following workpiece is subjected to the full pulling force of the auxiliary transport device until said following workpiece has been advanced a sufficient distance to be acted upon by said auxiliary transport device. With a condition of this sort, the pulling force which the auxiliary transport device applies to the chain is such that it is possible to easily overstress the threads, for said auxiliary transport device is advancing or pulling the chain at a slightly faster rate than the stitching instrumentalities are able to manipulate the threads being withdrawn from a supply spool via a tensioning device to form said chain.

Subjecting the chain to a pulling force as described above is considered a very serious and undesirable condition and is especially troublesome when the threads utilized to form the stitches of a chain have no elasticity, for during this pulling force the forming of each stitch requires that the looper perform its function of taking a loop of thread from the needle as the latter is being withdrawn. Additionally, the fact that the looper is caused to travel in a direction different from the direction of pull of the auxiliary transport device further aggravates this condition.

It is not uncommon for the amount of pulling force provided by the auxiliary transport device to become greater than the strength of the threads so as to cause breakage thereof.

After linkage of the threads has been made to form the initial stitches in a workpiece which serves as a support for said threads, the pulling force changes gradually and in an amount which corresponds to the amount of fabric forming the workpiece that is being advanced by the auxiliary transport device. When the workpiece is no longer in a position to oppose the pulling force of the auxiliary transport device, the threads are subjected to the full pulling force thereof.

Breakage of a chain of stitches by the pulling force of the auxiliary transport device interrupts the continuity of the sewing operation on the next following workpiece for there is no means for drawing or guiding the same, without manual intervention, to a position to be acted upon by the auxiliary transport device. This undesireable condition is more troublesome in sewing machines where the main transport device is formed by counter-rotating disc members and the auxiliary transport device by two counter-rotating rollers that are intermittently rotated in synchronization with said disc members and where the axes of rotation of the latter are vertically disposed so that the workpiece is also supported vertically as it is caused to be advanced therebetween.

The main object of the present invention is to improve the performance of the sewing machine by eliminating the problem of chain breakage and during the absence of a workpiece to effect a desired closing of each stitch forming the chain.

To eliminate the problem of chain breakage the invention provides a means for reducing the tension on the threads, when a workpiece is absent during machine operation, down to a value which is sufficient to adequately effect linkage of the threads so as to form a chain. Additionally, the invention also includes a means for returning the thread tension to a normal operating value when a workpiece is present in order to obtain the desired closing of the stitches being formed in said workpiece.

SUMMARY OF THE INVENTION

To accomplish the intended function of the present invention, a workpiece sensing element is mounted in the sewing area and is operatively connected to tensioning devices individual to each thread and is effective in automatically changing from one tension value to another in accordance with the presence or absence of a workpiece located between the disc members of the main transport means.

A desirable feature forming a part of the invention is that the tensioning devices for the threads include at least one pair of tensioning elements for each one of said threads. The first of each pair of tensioning elements is adjusted to a predetermined value that is adapted to facilitate manipulation of its respective thread by the stitching instrumentalities when a workpiece is not present in the main transport device. The second of the pair of tensioning elements is adjusted to a value which differs from the first in order to create frictional cooperation with the latter on their respective thread during the formation of a seam in a workpiece. The main advantage for arranging the tensioning elements in this manner in the absence of a workpiece is that of reducing the thread tensions to a value whereby the threads pass through the needle and looper with less resistence and form a proper chain of stitches while being subjected to the pulling force produced by the rollers of the auxiliary transport device.

A further advantage is that of being able to quickly and easily adjust to the slacker tension of each thread during operation of the machine when a workpiece is absent and then quickly and automatically readjust to the greater tension which in addition to the previous tension is required in order to properly form and close the stitches of a seam being formed in a workpiece.

These and other advantages of the present invention will become more fully apparent by reference to the appended claims and as the following detailed description proceeds in reference to the figures of drawing wherein:

DESCRIPTION OF THE PREFERREN EMBODIMENT

Figure 1:
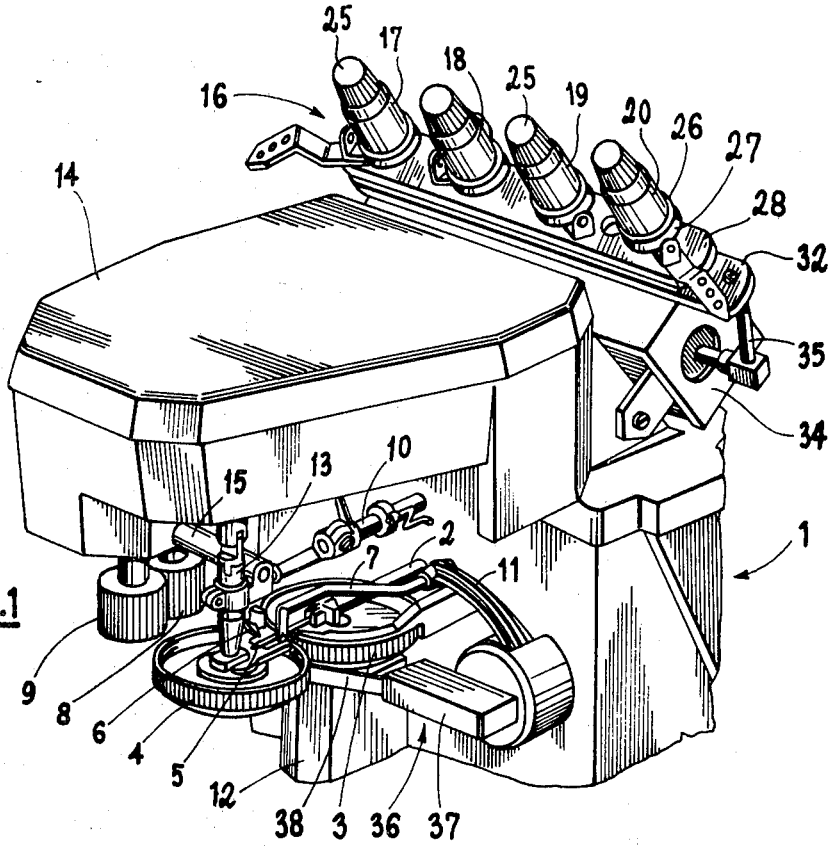
FIG. 1 is a perspective view of a portion of a sewing machine showing the thread tension control according to the invention applied thereto.

Now referring to the figures of drawing enough of a sewing machine is shown in FIG. 1 to serve as a basis for a detailed description of the invention applied thereto. Although the invention is shown applied to a sewing machine in which the main transport device defines a pair of counter-rotating disc members, it should be understood that the invention would be applicable to other types of machines which utilize auxiliary transport devices.

In FIG. 1 the sewing machine head is identified generally by numeral 1 and supports a conventional needle bar 2 that is caused to reciprocate to and fro in a horizontal plane in operative association with a pair of counter-rotating disc members 3 and 4 which form the main transport means for a workpiece being sewn.

The known stitching instrumentalities which cooperate in the formation of stitches include a needle 5 mounted on the needle bar 2, a central looper 6 and a side looper 7. Downstream of the sewing zone in which the above instrumentalities perform their intended function and in the direction of advance of a workpiece, an auxiliary transport device is mounted which is formed by two counter-rotating rollers 8 and 9 the axes of which are disposed vertically like those of the disc members 3 and 4. The rollers 8 and 9 are caused to rotate in synchronization with the disc members 3 and 4 for the purpose, which as is well known to those conversant in the art, of properly linking the threads utilized for seaming when the sewing machine continues to operate in the absence of a workpiece. Although the counter-rotating disc members 3 and 4 and the rollers 8 and 9 are synchronized in their rotation during operation of the sewing machine, they are arranged so as to rotate at different peripheral velocities.

More particularly the rollers 8 and 9 of the auxiliary transport device rotate faster than the disc members 3 and 4 and serve to maintain the fabric of the workpiece at a desirable length.

The difference in the velocity of rotation of the rollers 8 and 9 is necessary for the tension which is present in the threads for the proper closing of the stitches would create a condition of puckering or bunching of the workpiece so as to substantially reduce its intended length.

To prevent a condition of this nature during the sewing cycle, the workpiece is advanced from between the counter-rotating disc members 3 and 4 in an amount which is slightly less than the amount of pull being exerted on said workpiece by the rollers 8 and 9. Advancing the workpiece in this manner effectively opposes the tension in the seaming threads by a predetermined amount which is sufficient to maintain the workpiece in a stretched condition while causing the stitches formed and closed in a desired manner.

The central looper 6 is mounted on the outer end of a bar 10 which as is well known is caused to follow a curvilinear pathway as it moves to and fro so that it intersects the pathway of the needle 5 perpendicularly.

In particular, the curvilinear path of the central looper 6 is contained within a vertical plane which is parallel to that in which the pathway of advancement of a workpiece extends.

The side looper 7 is attached to an arm 11 which moves to and fro about a horizontal axis that is parallel to the needle bar 2 and causes said side looper 7 to travel along a pathway which is substantially vertical. The disc member 3 is intermittently rotated by a known type of drive not shown which is housed within the base portion of the sewing machine that is depicted by numeral 12. The disc member 4 is driven in a like manner and is fixed on the lower end of a depending shaft 13 which is connected to a known source of drive not shown that is housed within that portion of the sewing machine head identified by numeral 14.

A bar 15 extending from the lower part of that portion of the sewing machine head depicted by numeral 14 forms a part of a control mechanism (not shown) contained therein and being operatively connected to the depending shaft 13, it serves as a means for moving the disc member 4 a sufficient distance away from the disc member 3 so as to permit the insertion of a new workpiece therebetween.

As is well known to those conversant in the sewing art, the sewing threads controlled by the needle and the looper are both subjected to a pre-determined amount of tension which is provided by a tensioning device identified generally in FIG. 1 by numeral 16. This tensioning device includes a separate pair of tensioning elements for each thread and are depicted by numerals 17 and 18 and 19 and 20 respectively. The pair of tensioning elements 17 and 18 serve to provide a selected amount of tension to the thread controlled by the needle 5 and the pair of tensioning elements 19 and 20 provide the proper amount of tension to the thread for the central looper 6. As described above, each of the threads being drawn from its respective supply spool is drawn through a separate pair of tensioning elements individual thereto which provides a means whereby the tension on each thread will be increased or decreased depending on whether or not the chain is being formed during the presence or absence of a workpiece in the sewing zone.

The first tensioning elements 17 and 19 of each pair of elements are pre-set to a desired value of tension which is adequate only for forming a chain of stitches when a workpiece is absent in the sewing zone, and the second tensioning elements 18 and 20 of each pair are pre-set to a desired value of tension which in addition to the value of their associated first elements provides a tension to their respective threads which is adequate for properly forming and closing of the stitches of a seam in a workpiece. With the tensioning elements being arranged in this manner, it is only necessary that the second ones (18 and 20) of each pair be of the openable type so as, by a control device yet to be described, to release the added tension on their respective threads at the appropriate time.

Figure 3:
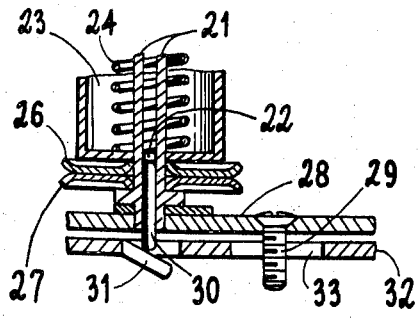
FIG. 3 is a sectional view showing one of the tensioning elements forming a part of the invention.
Figure 2:
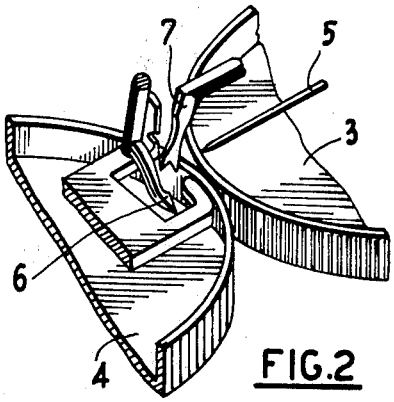
FIG. 2 is a perspective view of a portion of FIG. 1 and on an enlarged scale showing further detail of the main transport device and stitching instrumentalities.

Referring now to FIG. 3 that is a sectional view showing greater detail of one of the second tensioning elements which includes a hollow shaft 21 having a groove that slidably supports a cross-piece 22 formed in the bottom of a cup element 23. A coil spring 24 assembles on the shaft 21 and within the cup element in a manner to provide a biasing force that continually urges said cup element in a downwardly direction.

The biasing force of the spring 24 can be increased or decreased by means of a knob 25 which is threadably attached to the upper end of the shaft 21. A pair of opposed discs 26 and 27 are assembled on the shaft 21 immediately below the cup element 23 and are arranged to receive the biasing force applied to said cup element. So as to apply the required amount of drag and tension to the thread passing between said discs.

Shaft 21 is fixedly attached to a stationary plate member 28 that is attached to the sewing machine by means of screws 29 (one only shown in FIG. 3).

To open or separate the discs 26 and 27 so as to release the tension on the thread passing therebetween, a pin 30 is slidably assembled within the lower end of the hollow shaft 21 so that its upper end engages the cross-piece 22 and with its lower end in contact with an inclined tab 31 that forms an integral part of a slidable plate member 32. This slidable plate member 32 is supported by any suitable means not shown for sliding movement in close proximity with the underside of the stationary plate member 28.

The screws 29 which attach the stationary plate 20 to the sewing machine extend through elongated openings 33 (FIG. 3) in the slidable plate member 32 and provide the necessary clearance for effecting movement of the latter by a control means 34. This control means 34 can be of any suitable type such as an electro-magnet device having an actuating arm 35 interconnecting it with the slidable plate 32.

To cause the slidable plate member 32 to be moved by the control means 34 a sufficient distance to either open or close the discs of the second tensioning elements 18 and 20, said control means is operatively connected to a workpiece sensing device generally indicated in FIG. 1 by numeral 36. This sensing device defines a switch member 37 having an actuating element in the form of an elongated blade member 38 that is disposed so as to be engaged by a workpiece being acted upon by the disc members 3 and 4 of the main transport means.

Insertion of a workpiece between the disc members 3 and 4 effects displacement of the blade member 38 a sufficient distance to cause deactivation of the control means 34 that is operatively connected to the slidable plate member 32. With the slidable plate member not being held in position by the arm 35 of the electro-magnet, it is then caused to slide under the influence of a spring not shown in a direction which causes pin 30 to descend a sufficient distance to close the discs of the second tensioning elements 18 and 20 and thus restore the tension of their respective threads to that value which is required for the proper forming and closing of stitches in a workpiece.

Upon completion of seaming in a workpiece and at the moment it loses contact with the disc members 3 and 4 and is being acted upon solely by the rollers 8 and 9, the blade member 38 returns to its free position which causes activation of the control means 34. Activation of the control means 34 once again reduces the tension on the threads to a value where they will not be overstressed by the auxiliary transport device so that the chain of stitches will be formed in a desirable manner during the absence of a workpiece.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A thread tension control for the threads of a looper and the needle in sewing machines for forming stitches of the double chain type on a succession of workpieces, and of the type having a main transport means associated with the sewing area defined by the looper and needle and an auxiliary transport device spaced from and in alignment with the main transport means, said thread tension control comprising:

(a) a separate tensioning device for the looper thread and the needle thread mounted on the machine including:

(i) at least one pair of tensioning elements for each thread defining opposed spring biased discs between which the thread passes with one of said pair being of the pre-set type and the other of the openable type for effecting release of the thread tension imposed thereby;

(b) means operatively associated with the main transport means for sensing the presence and absence of a workpiece therein including:

(i) a switch member (37) with an actuating blade member (38);

(c) control means operatively connected to said switch member and blade member for effecting actuation thereof upon reception of a workpiece by the main transport means to effect application of tension on the threads by both tensioning elements of each tensioning device and the release of tension applied by one of each pair of tensioning elements during advance of the workpiece solely by the auxiliary transport device, said control means including:

(i) a slidable plate member (32) operatively connected to each of the openable type tensioning elements; and (ii) an electromagnet connected to said switch member (37) having an actuating arm (35) operatively connected to said slidable plate member (32) for moving the latter between positions for opeing and closing the tensioning elements in accordance with the dictates of said switch member (37).

2. The thread tension control according to claim 1 wherein the openable tensioning elements include a slidable pin (30) having one end operatively associated with one of the opposed discs thereof and the opposite end disposed in engagement with an inclined tab (31) provided in said slidable plate member (32).

* * * * *